US012484653B2

(12) United States Patent
Cooper et al.

(10) Patent No.: US 12,484,653 B2
(45) Date of Patent: Dec. 2, 2025

(54) SWIMMING POOL SCRUBBER SHOE

(71) Applicants: Fredrick Cooper, Baytown, TX (US); Jessica Cooper, Baytown, TX (US)

(72) Inventors: Fredrick Cooper, Baytown, TX (US); Jessica Cooper, Baytown, TX (US)

( * ) Notice: Subject to any disclaimer, the term of this patent is extended or adjusted under 35 U.S.C. 154(b) by 339 days.

(21) Appl. No.: 18/142,366

(22) Filed: May 2, 2023

(65) Prior Publication Data

US 2024/0365917 A1 Nov. 7, 2024

(51) Int. Cl.

| | |
|---|---|
| ***A46B 5/04*** | (2006.01) |
| ***A43B 3/16*** | (2022.01) |
| ***A43B 3/18*** | (2022.01) |
| ***A43B 3/20*** | (2022.01) |
| ***A46B 15/00*** | (2006.01) |

(52) U.S. Cl.

CPC ..... *A43B 3/20* (2013.01); *A43B 3/18* (2013.01); *A46B 5/04* (2013.01); *A46B 15/0055* (2013.01); *A46B 2200/3073* (2013.01)

(58) Field of Classification Search

CPC ..... A47L 13/10; A47L 13/282; A47L 13/26; A63B 57/60; A46B 15/00; A46B 3/18

See application file for complete search history.

(56) References Cited

U.S. PATENT DOCUMENTS

| | | | | | |
|---|---|---|---|---|---|
| 1,493,322 | A * | 5/1924 | Carter | A43C 15/06 | 36/62 |
| 2,571,606 | A * | 10/1951 | Peterson | A47L 13/282 | 15/229.4 |
| 3,085,541 | A | 4/1963 | Leach | | |
| 3,460,182 | A * | 8/1969 | Grande, Jr. | A47L 13/282 | 15/227 |
| 3,699,672 | A * | 10/1972 | Sims | A43B 3/00 | 36/7.7 |
| 4,693,022 | A * | 9/1987 | Terhune | A43B 23/20 | 30/297 |
| 6,145,156 | A * | 11/2000 | Pullara, Jr. | A47L 13/18 | 220/571 |
| 7,845,043 | B2 * | 12/2010 | McLogan | A47L 13/282 | 36/8.1 |
| 9,723,914 | B2 | 8/2017 | Connelly | | |
| 10,022,033 | B1 * | 7/2018 | Maynard | A46B 15/0055 | |
| D871,774 | S | 1/2020 | Potut | | |
| 10,765,197 | B2 | 9/2020 | Peterson | | |
| 11,026,554 | B2 * | 6/2021 | Peters, Jr. | A46B 11/0072 | |
| 2007/0240330 | A1 | 10/2007 | Beasley | | |
| 2008/0216270 | A1 * | 9/2008 | McLogan | A47L 13/20 | 15/227 |
| 2008/0216271 | A1 * | 9/2008 | Marler | A47L 13/20 | 15/227 |
| 2009/0113646 | A1 * | 5/2009 | Rossell | A43B 3/108 | 36/103 |
| 2010/0088928 | A1 * | 4/2010 | Sarantakos | A43C 11/1493 | 36/103 |
| 2010/0242199 | A1 * | 9/2010 | Hogan | A47L 13/282 | 15/227 |

(Continued)

*Primary Examiner* — Michael D Jennings

(57) ABSTRACT

A cleaning apparatus for cleaning surfaces in a swimming pool includes a body to which a scrubber member is attached for scrubbing surfaces of a swimming pool. The body is attachable to a foot of a user by receiving the foot into a cavity defined by the body. A method of using the cleaning apparatus to clean the surfaces of the swimming pool is also provided.

6 Claims, 6 Drawing Sheets

(56) References Cited

U.S. PATENT DOCUMENTS

| | | | | |
|---|---|---|---|---|
| 2016/0045021 | A1* | 2/2016 | Connelly | A46B 5/04 15/246 |
| 2020/0154971 | A1* | 5/2020 | Peters, Jr. | A43B 13/36 |
| 2022/0273155 | A1* | 9/2022 | Curcio | A46B 5/04 |

* cited by examiner

SWIMMING POOL SCRUBBER SHOE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to scrubbing apparatuses and more particularly pertains to a new scrubbing apparatus for cleaning surfaces in a swimming pool.

(2) Description of Related Art Including Information Disclosed Under 37 CFR 1.97 and 1.98

The prior art describes a variety of scrubbing apparatuses which are worn on the feet and used to clean a surface. These scrubbing apparatuses include scrubbers which include a cavity for inserting the front of the foot into the body and a strap which attaches to the body and wraps around the back of the foot to secure the body to the foot. However, the prior art does not describe such an apparatus which is used to clean surfaces in a swimming pool while the swimming pool is filled with water.

BRIEF SUMMARY OF THE INVENTION

An embodiment of the disclosure meets the needs presented above by generally comprising a body with a base wall and a top wall, in which the top wall extends along and is attached to a front of the base wall and a pair of lateral sides of the base wall such that the top wall extends over and is spaced from the base wall. The base wall and the top wall bound a cavity for receiving a front portion of the foot. A scrubbing member is coupled to a bottom surface of the base wall and is positioned adjacent to the front of the base wall.

Another embodiment of the disclosure includes a method of cleaning a swimming pool. The method comprises attaching a cleaning apparatus to a foot of a user such that a scrubber member of the cleaning apparatus is positioned facing away from a sole of the foot. The user is positioned in a basin bounded by the swimming pool, and at least one of a floor surface and an interior wall surface of the swimming pool is scrubbed with the scrubber member of the cleaning apparatus.

The basin may contain a volume of water, and the method may consequently comprise maintaining at least a portion of a head of the user above the volume of water. To attach the cleaning apparatus to the foot of the user, a front portion of the foot may be inserted into a cavity formed by a body of the cleaning apparatus. The user may also have another shoe worn on the foot, in which case the shoe may be inserted into the cavity when attaching the cleaning apparatus to the foot. A strap may be secured around the foot to secure the cleaning apparatus to the foot, and a length of the strap may be adjusted so that the strap is maintained in engagement with the foot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
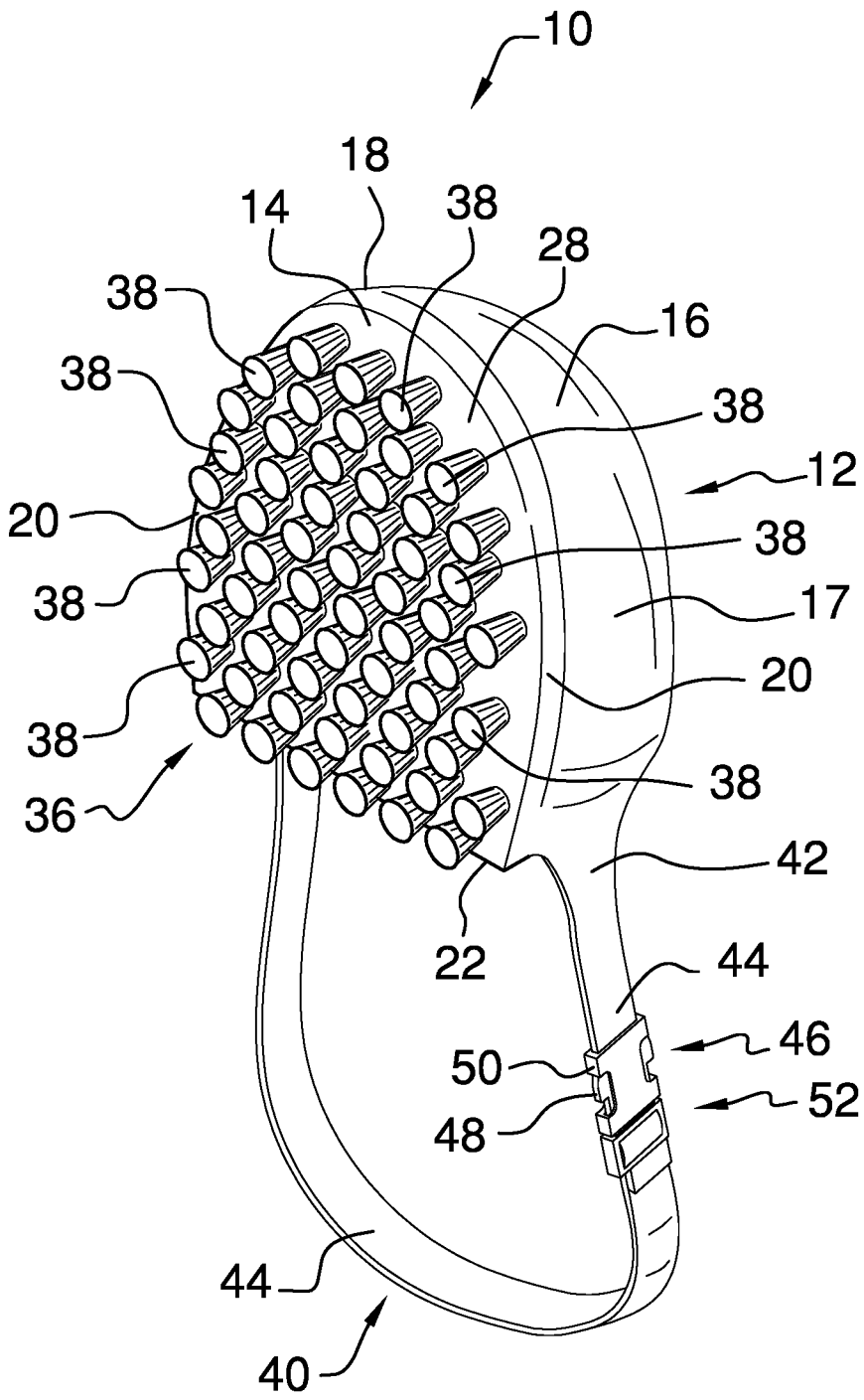
FIG. 1 is a bottom perspective view of a cleaning apparatus according to an embodiment of the disclosure.
Figure 2:
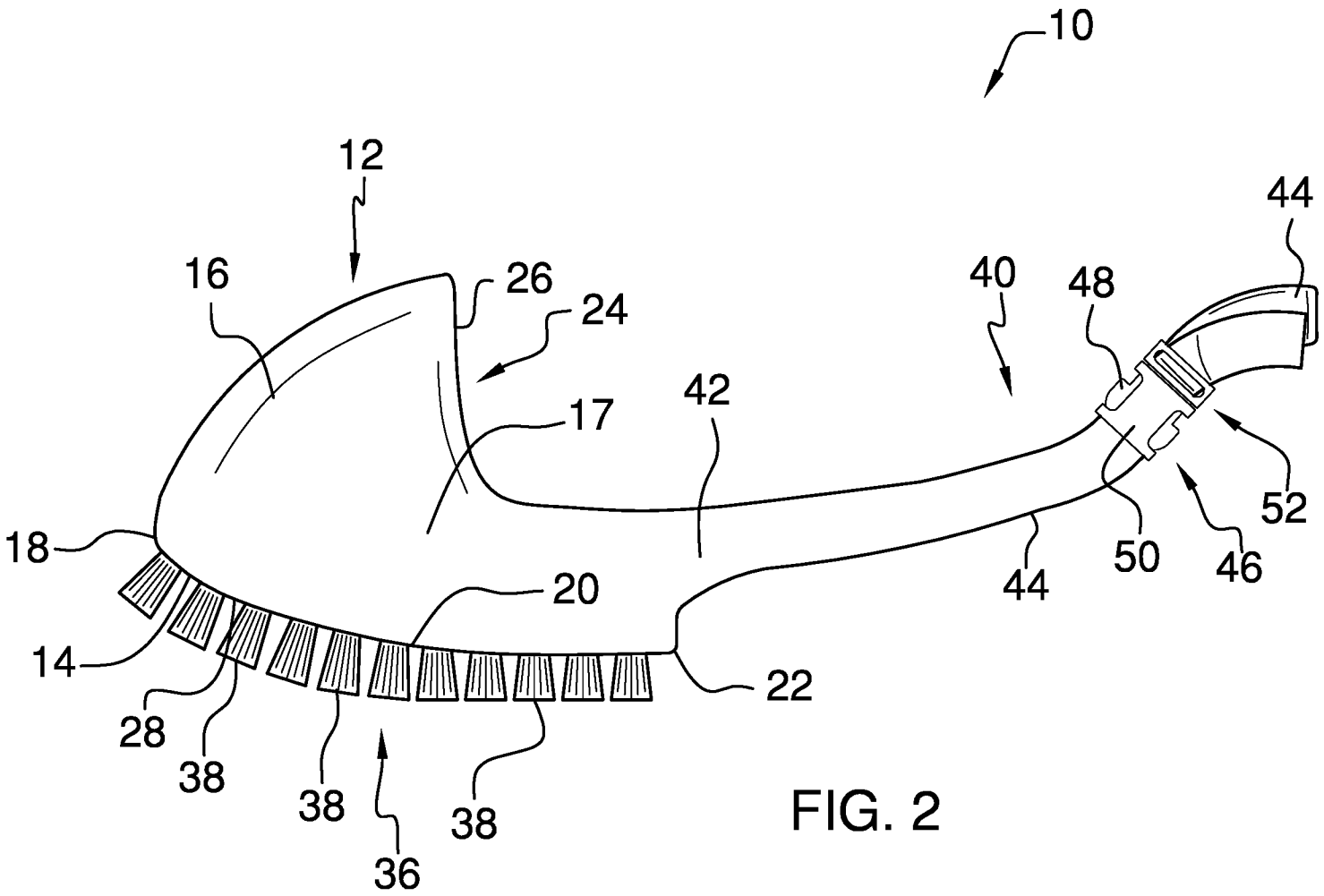
FIG. 2 is a side view of an embodiment of the disclosure.
Figure 3:
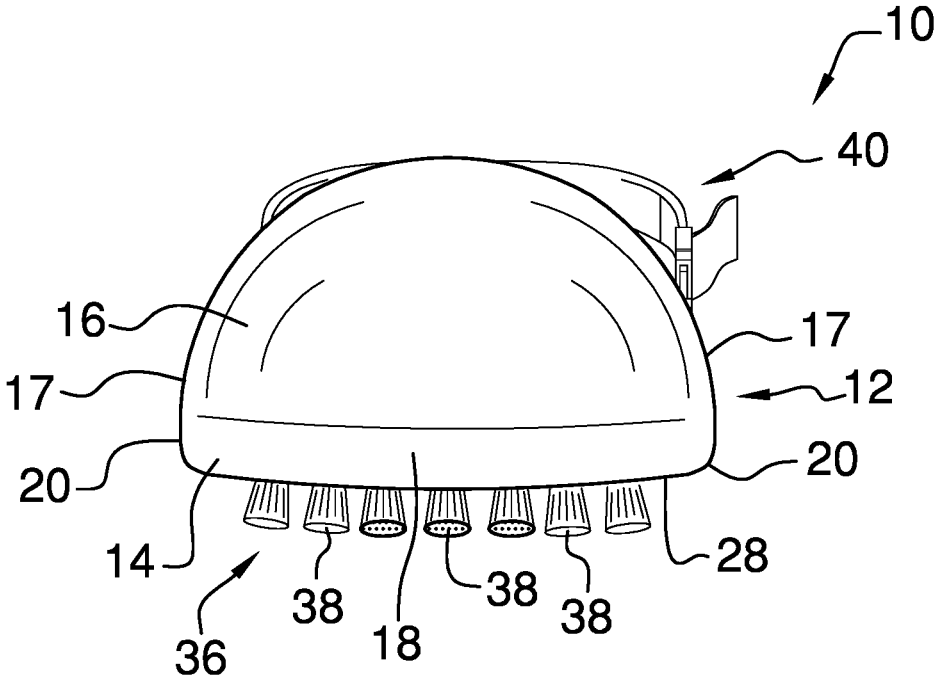
FIG. 3 is a front view of an embodiment of the disclosure.
Figure 4:
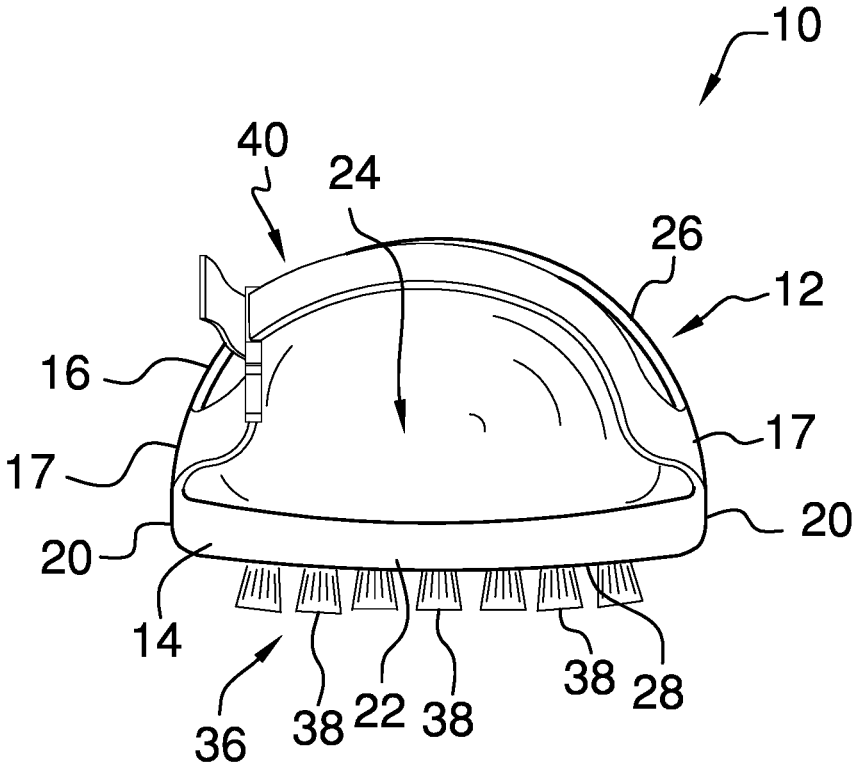
FIG. 4 is a back view of an embodiment of the disclosure.
Figure 5:
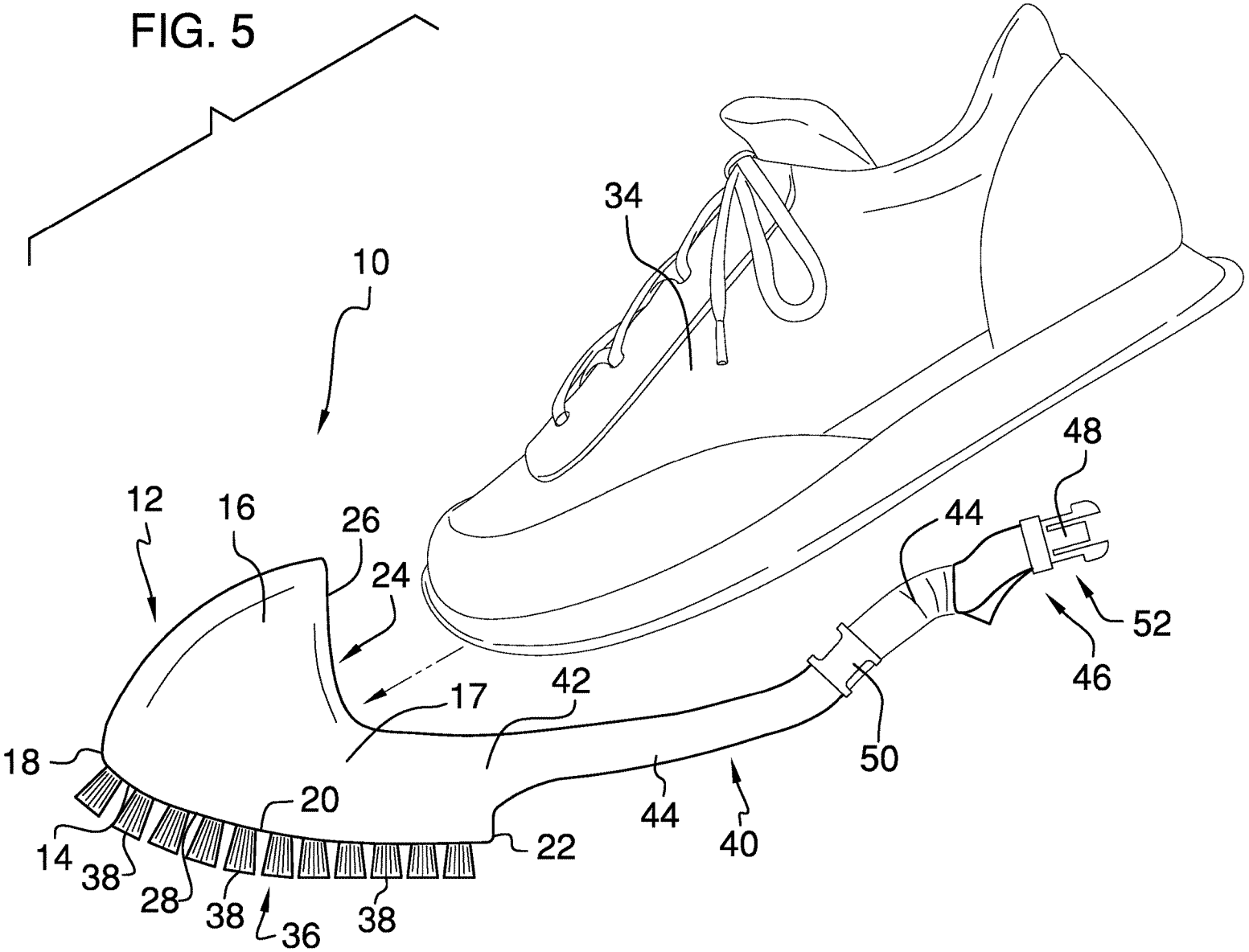
FIG. 5 is an in-use exploded view of an embodiment of the disclosure depicting a shoe being inserted into a body of the cleaning apparatus.
Figure 6:
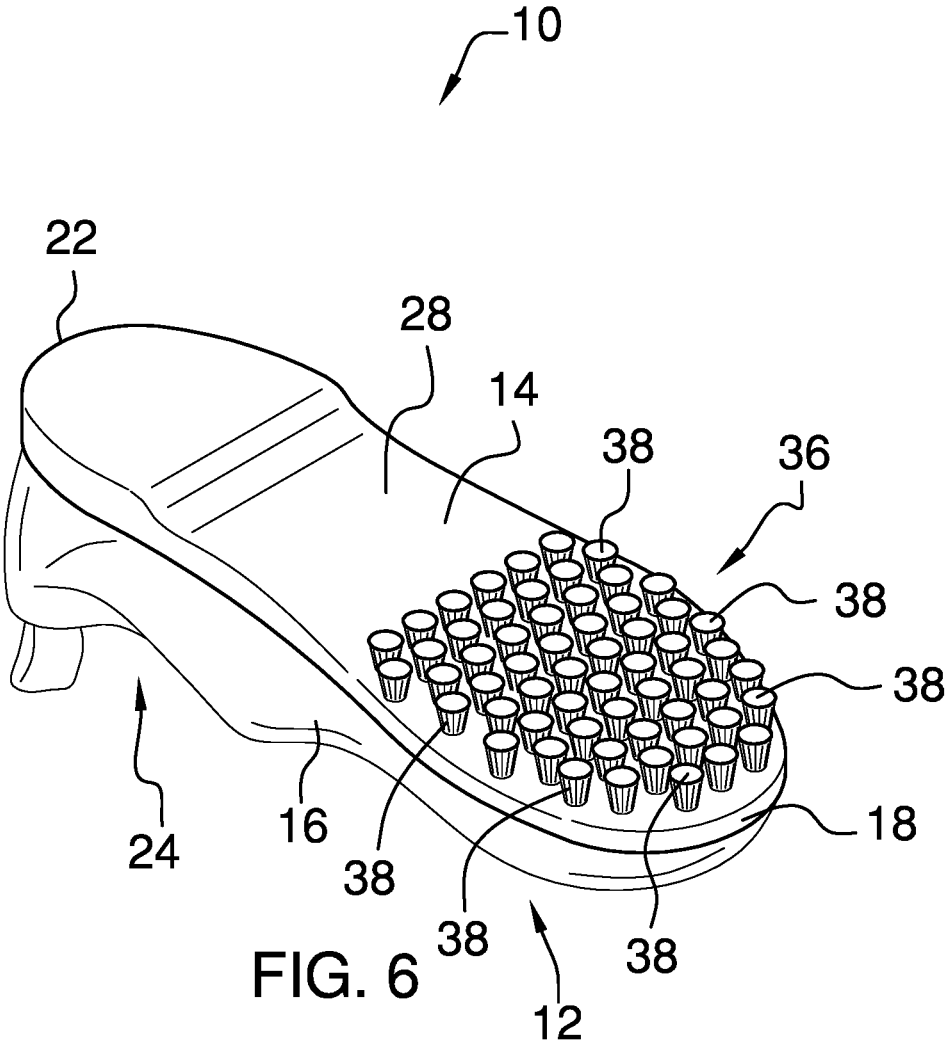
FIG. 6 is a perspective view of an alternative embodiment of the disclosure.
Figure 7:
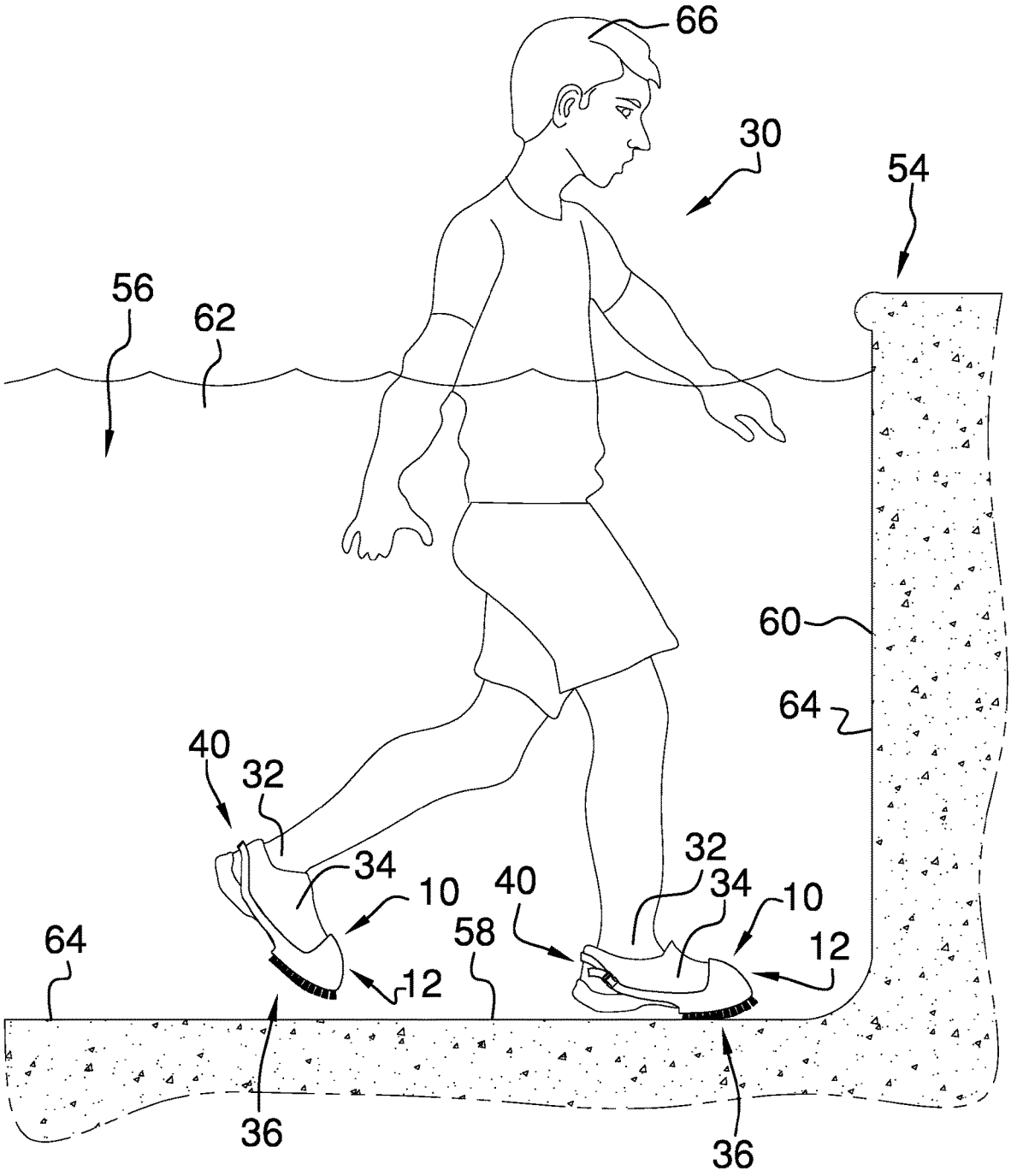
FIG. 7 is an in-use view of an embodiment of the disclosure.

With reference now to the drawings, and in particular to FIGS. 1 through 7 thereof, a new scrubbing apparatus embodying the principles and concepts of an embodiment of the disclosure and generally designated by the reference numeral 10 will be described.

As best illustrated in FIGS. 1 through 7, the cleaning apparatus 10 generally comprises a body 12 with a base wall 14 and a top wall 16, in which the top wall 16 extends along and is attached to a front 18 of the base wall 14 and a pair of lateral sides 20 of the base wall 14 such that the top wall 16 extends over and is spaced from the base wall 14. The base wall 14 and the top wall 16 bound a cavity 24 for receiving a front 18 portion of a foot 32 of a user 30. The body 12 has a back side 26 which is open and defines an entrance into the cavity 24. The cavity 24 is configured to receive a shoe 34 extended through the back side 26.

A scrubbing member 36 is coupled to a bottom surface 28 of the base wall 14 and is positioned adjacent to the front 18 of the base wall 14. The scrubbing member 36 extends from the front 18 of the base wall 14 to a rear 22 of the base wall 14. The scrubbing member 36 comprises a plurality of bristles 38 extends away from the base wall 14 but may comprise a frictionally enhanced surface, one or more wipers, or other conventional means for cleaning a surface via scrubbing or wiping.

A strap 40 is coupled to the body 12 and is configured to releasably secure the body 12 to the shoe 34 when the shoe 34 is positioned in the cavity 24 to retain the shoe 34 in the cavity 24. The strap 40 has a pair of ends 42, and each of a pair of lateral sides 17 of the top wall 16 has one of the pair of ends 42 of the strap 40 attached thereto. The strap 40 has a break therein which defines a pair of strap segments 44, which are releasably coupled to each other via a coupler 46. The coupler 46 includes a first mating member 48 attached to one of the pair of strap segments 44 and a second mating member 50 attached to another one of the pair of strap segments 44. The first and second mating members 48, 50 are releasably engageable with each other. The coupler 46 comprises a buckle 52 but may comprise a hook-and-loop fastener, a tie, a latch, or the like. The first mating member 48 is moveable along a length of an associated one of the pair of strap segments 44 such that a length of the strap 40 is adjustable.

In use, the cleaning apparatus 10 is attached to the foot 32 of the user 30. The user 30 goes into a basin 56 bounded by a swimming pool 54 and scrubs at least one of a floor surface 58 and an interior wall surface 60 of the swimming pool 54 to clean the at least one of the floor surface 58 and the interior wall surface 60. The cleaning apparatus 10 may be used while the basin 56 is filled with a volume of water 62. The user 30 can scrub surfaces 64 in the swimming pool 54 with the cleaning apparatus 10 while keeping at least a portion of the user's 30 head 66 out of the volume of water 62. The cleaning apparatus 10 facilitates the user 30 to reach areas of surfaces in a swimming pool 54 which cannot be reached by the user 30 with similarly sized hand-worn scrubbing devices while the user 30 keeps the user's 30 head 66 out of the volume of water 62.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A cleaning apparatus configured for attaching to a foot of a user to facilitate cleaning a surface of a swimming pool, the apparatus comprising:

a body having a base wall and a top wall, the top wall extending along and being attached to a front of the base wall and a pair of lateral sides of the base wall such that the top wall extends over and is spaced from the base wall, the base wall and the top wall bounding a cavity for receiving a front portion of the foot;

a scrubbing member being coupled to a bottom surface of the base wall, the scrubbing member being positioned adjacent to the front of the base wall;

a strap being coupled to the body and being configured to releasably secure the body to the shoe when the shoe is positioned in the cavity to retain the shoe in the cavity, the strap having a pair of ends, each of a pair of lateral sides of the top wall having one of the pair of ends of the strap attached thereto; and a coupler being coupled to the strap, the strap having a break therein which defines a pair of strap segments, the coupler releasably coupling the pair of strap segments together, wherein the coupler includes a first mating member attached to one of the pair of strap segments and a second mating member attached to another one of the pair of strap segments, the first and second mating members being releasably engageable with each other, the coupler comprising a buckle.

2. The cleaning apparatus of claim 1, wherein the body has a back side being open and defining an entrance into the cavity, wherein the cavity is configured to receive a shoe extended through the back side.

3. The cleaning apparatus of claim 1, wherein the scrubbing member extends from the front of the base wall to a rear of the base wall.

4. The cleaning apparatus of claim 1, wherein the scrubbing member comprises a plurality of bristles extending away from the base wall.

5. The cleaning apparatus of claim 1, wherein the first mating member is moveable along a length of an associated one of the pair of strap segments such that a length of the strap is adjustable.

6. A cleaning apparatus configured for attaching to a foot of a user to facilitate cleaning a surface of a swimming pool, the apparatus comprising:

a body having a base wall and a top wall, the top wall extending along and being attached to a front of the base wall and a pair of lateral sides of the base wall such that the top wall extends over and is spaced from the base wall, the base wall and the top wall bounding a cavity for receiving a front portion of the foot, the body having a back side being open and defining an entrance into the cavity, wherein the cavity is configured to receive a shoe extended through the back side; and a scrubbing member being coupled to a bottom surface of the base wall, the scrubbing member being positioned adjacent to the front of the base wall, the scrubbing member extending from the front of the base wall to a rear of the base wall, the scrubbing member comprising a plurality of bristles extending away from the base wall;

a strap being coupled to the body and being configured to releasably secure the body to the shoe when the shoe is positioned in the cavity to retain the shoe in the cavity, the strap having a pair of ends, each of a pair of lateral sides of the top wall having one of the pair of ends of the strap attached thereto, the strap having a break therein which defines a pair of strap segments; and a coupler being coupled to the strap and releasably coupling the pair of strap segments together, the coupler including a first mating member attached to one of the pair of strap segments and a second mating member attached to another one of the pair of strap segments, the first and second mating members being releasably engageable with each other, the coupler comprising a buckle, the first mating member being moveable along a length of an associated one of the pair of strap segments such that a length of the strap is adjustable.

* * * * *